US005388927A

United States Patent [19]

Ulmer et al.

[11] Patent Number: 5,388,927

[45] Date of Patent: Feb. 14, 1995

[54] RAISEABLE PAN DRAG APPARATUS

[75] Inventors: Ewald R. Ulmer; Larry G. Eben, both of Canton, S. Dak.

[73] Assignee: CMI Corporation, Oklahoma City, Okla.

[21] Appl. No.: 36,930

[22] Filed: Mar. 25, 1993

[51] Int. Cl.[6] ..... E01C 19/48

[52] U.S. Cl. ..... 404/84.5; 404/119; 404/118

[58] Field of Search ..... 404/118, 119, 88, 100, 404/84.1, 84.2, 84.5; 172/780, 799.5

[56] References Cited

U.S. PATENT DOCUMENTS

| | | | |
|---|---|---|---|
| 3,936,209 | 2/1976 | Krage | 404/118 |
| 3,992,124 | 11/1976 | Schrader | 404/118 |
| 4,433,936 | 2/1984 | Moser | 404/118 |
| 4,702,642 | 10/1987 | Musil | 404/118 |

*Primary Examiner*—Ramon S. Britts
*Assistant Examiner*—Pamela A. O'Connor
*Attorney, Agent, or Firm*—Emrich & Dithmar

[57] ABSTRACT

A pan drag device is disclosed for attachment to a concrete finishing machine movable longitudinally along an elongated body of poured concrete, with the finishing machine having a finishing unit engageable with the surface of the poured concrete and movable transversely across the body of concrete to grade the concrete. The pan drag device includes support members mounted to and extending rearwardly from the finishing unit and movable with the finishing unit and pan drag apparatus mounted to the support members for engaging the graded concrete surface to finish and seal the concrete surface. The pan drag device further includes a hydraulically actuated piston and cylinder member for raising and lowering the pan drag apparatus with respect to the concrete surface and apparatus for controlling the hydraulically actuated piston and cylinder member for raising and lowering the pan drag apparatus between an upward raised position to a downward engaging position to permit the pan drag apparatus to engage the graded concrete surface to seal and finish the concrete surface.

24 Claims, 4 Drawing Sheets

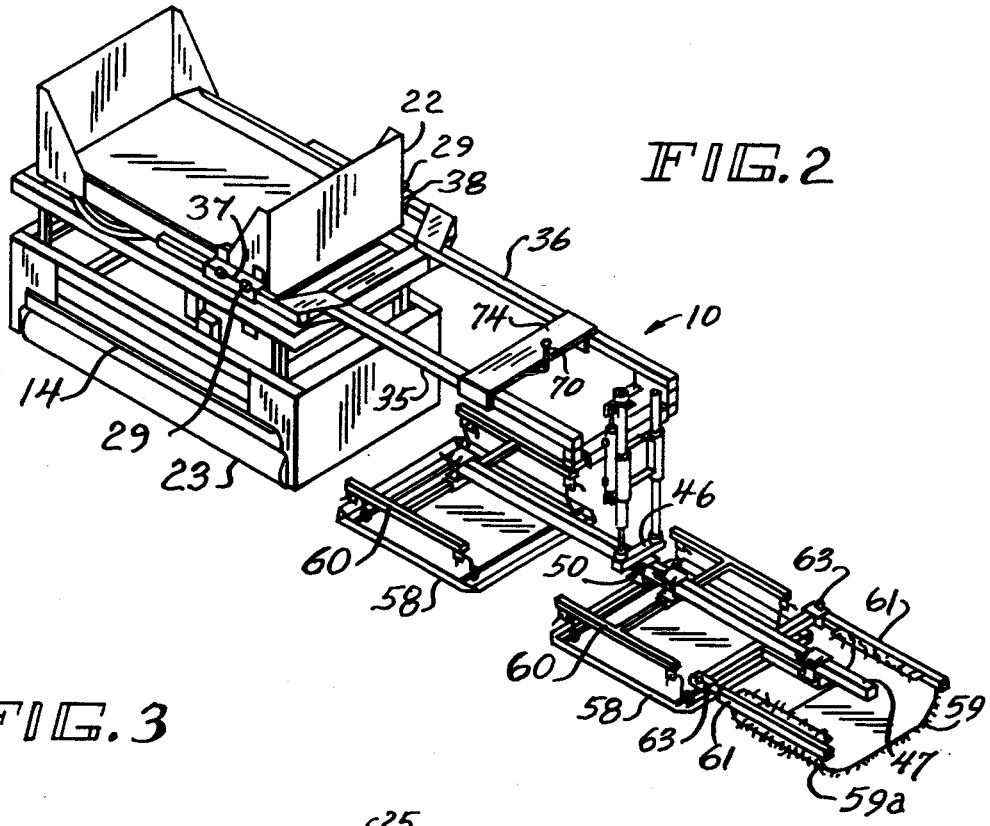
FIG. 2
FIG. 3
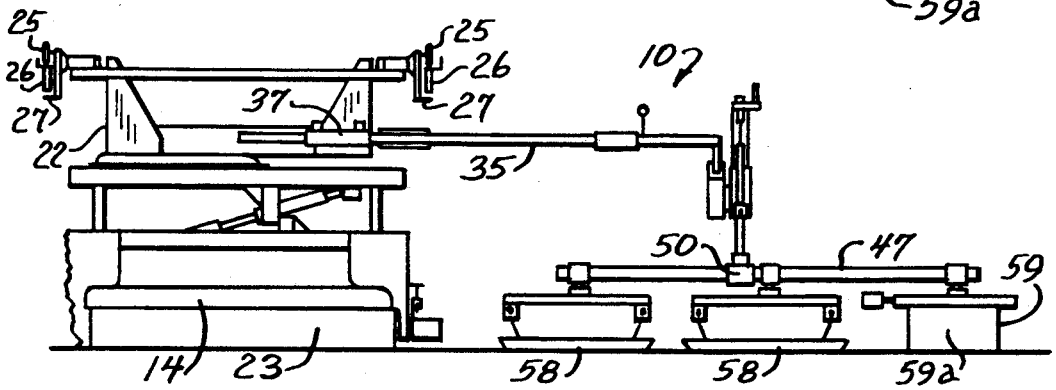
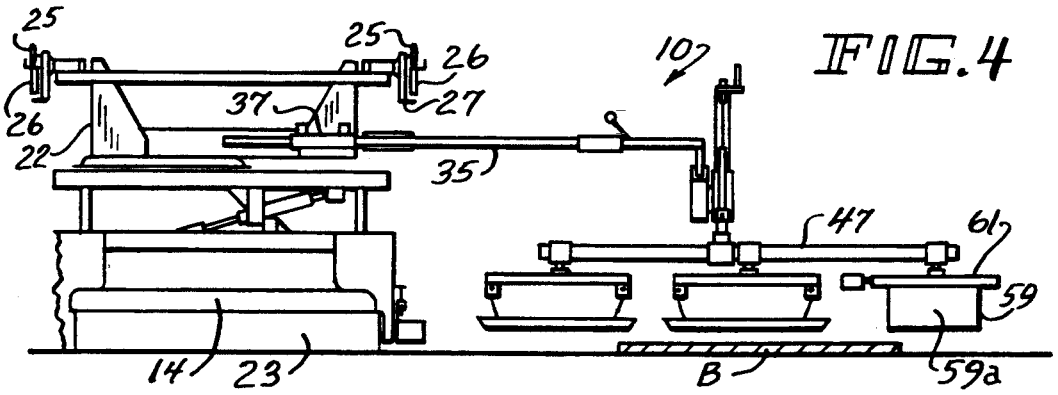
FIG. 4

RAISEABLE PAN DRAG APPARATUS

BACKGROUND OF THE INVENTION

The present invention relates to a concrete finishing machine having a raiseable pan drag apparatus associated with the machine which is independently operable to engage the concrete to finish and seal the concrete surface.

Concrete leveling or finishing machines are utilized for paving highways, streets or airport runways and generally include a leveling and surfacing carriage or unit which is moveable transversely back and forth across the plane of the leveling machine to engage the concrete on the street, runway or roadway to level and finish the concrete to the grade profile. Typically, such concrete leveling machines include a pan drag apparatus extending rearwardly from the moveable carriage or leveling unit. The pan drag device engages the leveled concrete to finish and seal the concrete surface. However, when paving streets, airports or highways, box-outs often exist in the prepared roadway where future manhole covers or runway marker lights will be located. The box-outs are generally one to four inches higher than the finished concrete grade. When the concrete leveling machine engages a box-out in the roadway, it is necessary to raise and lower the carriage or finishing unit to clear the box-out. Such raising and lowering of the carriage unit does not however disengage the suspended pan drag device that trails the carriage unit to contact the concrete surface. Accordingly, the pan drag device must also be raised to clear the box-out. Such raising and lowering of the pan drag apparatus must be done manually by the operator of the leveling machine. This process consumes valuable labor time and requires the shut down of the leveling machine to disengage and raise the pan drag device from the concrete surface to clear the box-outs.

Additionally, in some paving operations, the paving specification may require that a steel reinforcement grid or mat be positioned within the center of the poured concrete slab. For example, if the poured concrete slab is to be ten inches deep with a reinforcement grid positioned intermediate the thickness of the slab, the operator of the concrete leveling machine would disengage and raise the pan drag device and roughly finish the concrete slab to a depth of about five inches for a distance of seventy-five to one hundred feet. Thereafter, the leveling machine is returned to the starting point and the steel reinforcement mat or grid is positioned on the leveled five inch bed of poured concrete. Then, the second lift of concrete is poured over the reinforced grid and the leveling machine is now engaged with the concrete to level the same. This process requires additional time to manually lower the pan drag device to engage the finished concrete surface to seal the finished surface. This results in extended down time of the leveling machine which is time consuming and increases the costs of pouring, leveling and finishing concrete.

SUMMARY OF THE INVENTION

Accordingly, it is one object of the present invention to provide a concrete finishing machine having a raiseable pan drag apparatus which is independently operable to engage the poured and leveled concrete to finish and seal the concrete surface.

A further objection of the present invention is to provide a novel apparatus for attachment to a movable carriage finishing unit which is independently operable to be raised and lowered as desired to permit the pan drag apparatus to engage and seal the concrete surface.

Still a further object of the present invention is to provide a hydraulically powered raiseable pan drag apparatus for use with a movable carriage finishing unit of a concrete finishing machine.

It is still a further object of the present invention to utilize a raiseable pan drag apparatus having separable rigided drag pans and flexible textured finishing components.

The present invention relates to a concrete pan drag apparatus for use in conjunction with a concrete finishing machine which is moveable longitudinally along an elongated body of concrete. The concrete finishing machine includes a finishing carriage unit engageable with the surface of the concrete and movable transversely across the body of the concrete. The concrete pan drag apparatus includes a supporting means mounted to and extending rearwardly from the carriage finishing unit, with the supporting means being movable with the finishing unit transversely across the body of the concrete. The pan drag apparatus or means is mounted to the supporting means and extends rearwardly from the finishing unit for engaging the concrete surface to finish and seal the same. The pan drag apparatus or means includes power and control means for raising and lowering the pan drag means with respect to the concrete surface independently of the operation of the carriage finishing unit.

Other and further objects of the present invention will be apparent from the following description and claims and are illustrated in the accompanying drawings which, by way of illustration, show a preferred embodiment of the present invention and the principles thereof and what we now consider to be the best mode in which we have contemplated applying these principles. Other embodiments of the present invention providing the same or equivalent principles may be used and structural changes may be made as desired by those skilled in the art without departing from the present invention and the purview of the appended claims.

DESCRIPTION OF THE DRAWINGS

FIG. 2, is a perspective view illustrating the attachment of the raiseable pan drag apparatus to the carriage finishing unit of the concrete leveling machine in accordance with the present invention;

FIG. 3, is a side view of the raiseable pan drag apparatus in the downward engaging position whereby the pan drag apparatus is finishing and texturing the concrete surface in accordance with the present invention;

FIG. 4, is a side view of the raiseable pan drag apparatus illustrating the raiseable pan drag apparatus in the upward disengaging position in accordance with the present invention;

DESCRIPTION OF A PREFERRED EMBODIMENT

Figure 1:
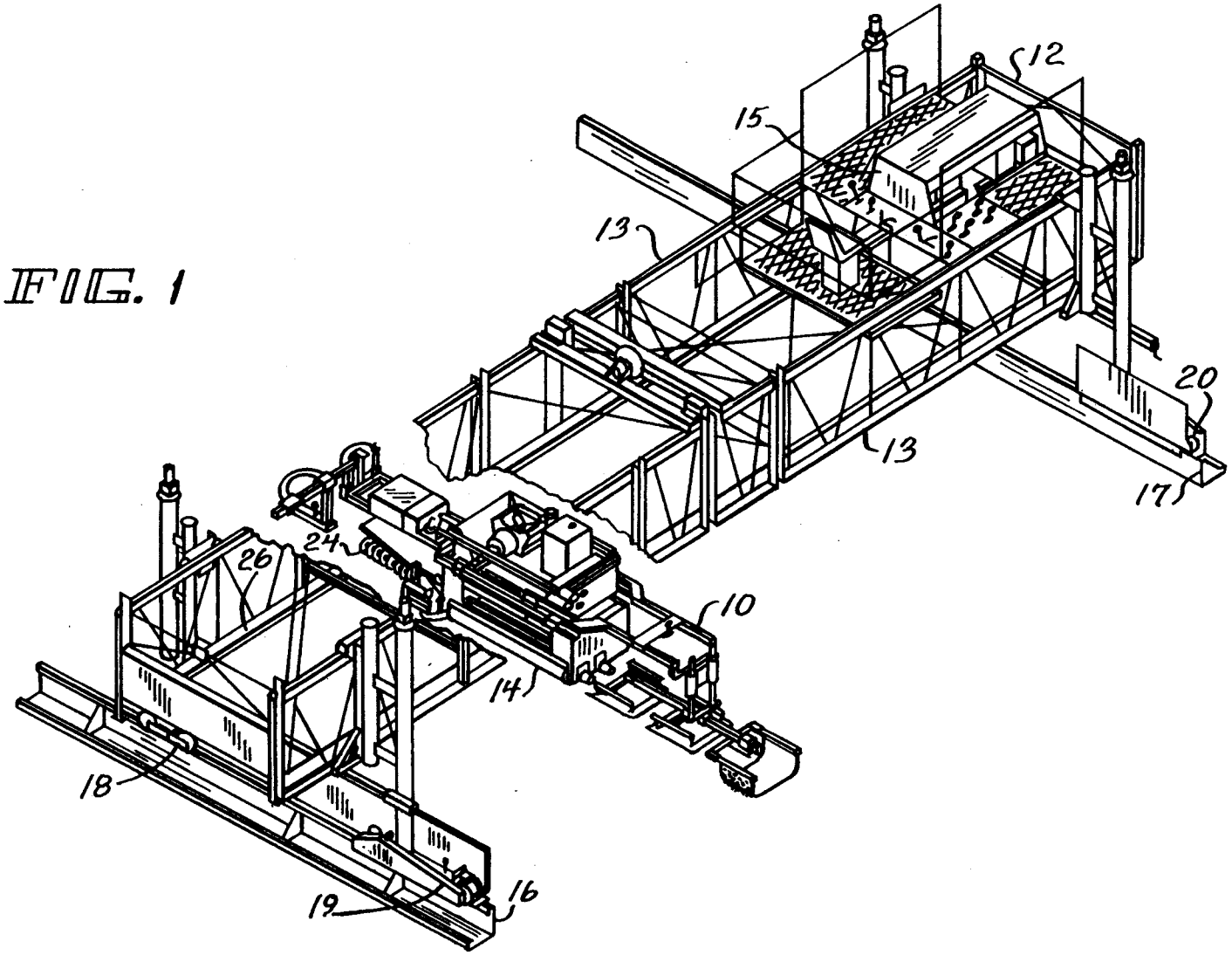
FIG. 1, is rear perspective view of a concrete finishing machine embodying the concrete pan drag apparatus in accordance with the present invention disposed in an operative position over a roadway.

Referring now to the drawings wherein like numerals have been used throughout the several views to designate the same or similar parts, in FIGS. 1–7, a pan drag apparatus 10, embodying the principles of the present invention, is shown in the drawings mounted on and as an integral part of a concrete finishing or leveling machine 12. The concrete leveling machine 12 is illustrated in FIG. 1 disposed in operative position over a section R of a concrete roadway, street or runway.

The concrete leveling machine 12 embodies an elongated trust work or frame 13 on which is mounted a carriage or surfacing unit 14 which is moveable longitudinally of the frame 13, with a control console or means 15 mounted on the frame 13 from which an operator may control operation of the concrete leveling machine 12. The frame 13 is adapted to extend transversely of the roadway being finished and the machine 12 is adapted to be moved lengthwise of the roadway in a direction transverse to the length of the frame 13. In the concrete leveling machine 12 shown in FIG. 1, horizontally extending supports 16 and 17 are positioned on opposite sides of the roadway R and extend lengthwise of the roadway to be finished, the upper edges of supports 16 and 17 are adapted to operatively receive a pair of boggies 18 and 19 and 20 and 21, respectively, mounted on opposite ends of the frame 13 to permit the frame to be moved along the supports 16 and 17. As further illustrated in FIGS. 2–6 and 10, the concrete finishing member or unit 14 includes a carriage 22 having substantially horizontally extending elongated concrete smoothing members or cylinders 23 journalled in and suspended from the lower portion of the carriage 22. As partially shown in FIG. 1, extending forwardly of each of the cylinders 23 are a pair of augers 24 in substantially horizonal spaced relation to each other. Although only partially shown in FIG. 1, the augers 24 are arranged such that rotation of the augers during the operation of the finishing and leveling machine 12 are effective to engage the concrete to move the concrete towards the space between the augers and longitudinally outwardly away from the cylinders 13 to permit the cylinders 23 to finish the concrete on the roadway to the desired grade, as is known in the art.

The carriage 22, as illustrated in FIGS. 2–6 and 10, includes two pairs of a outwardly projecting horizontally spaced rollers 25 mounted on respective upper ends of the carriage 22. In the assembled concrete finishing machine 12, the rollers 25 are disposed in position to be supported by and riding along the elongated tracks 26 (FIGS. 1 and 10) disposed on opposite sides of the frame 13. The tracks thereby support the carriage portion 22 of the finishing unit 14 for movement longitudinally of the frame 13. A pair of hold-down brackets 27 (FIGS. 3, 4 and 10) are mounted on each of the upper ends of the carriage 22 below the respective tracks 26 to hold and retain the rollers 25 in engagement with the tracks. This structure permits the finishing member or unit 14 to be moved transversely across the roadway R by a suitable drive mechanism (not shown), as is known in the art.

The pan drag means or apparatus 10, shown in the drawings, is mounted rearwardly to the concrete finishing member or unit 14, for movement therewith. The mounting of the pan drag apparatus 10 embodies substantially parallel members or legs 35 and 36 projecting forwardly from a tubular mounting member 31 (FIGS. 5 and 6) to a position under the frame 13 on respective opposite sides of the finishing member or unit 14. Each of the legs 35 and 36 is disposed within sleeves 37 and 38 mounted on respective sides of the carriage 22 portion of unit 14 (FIG. 2). The legs 35 and 36 are slidable mounted in the sleeves 37 and 38, respectively, for forward and rearward movement therethrough relative to the frame 13, for adjusting the rearward position of the pan drag means or apparatus 10 relative to the concrete finishing machine 12. The parallel legs or weldments 35 and 36 may be releasably and adjustably secured in the respective pair of sleeves 37 and 38 by suitable means such as bolts 29.

Figure 5:
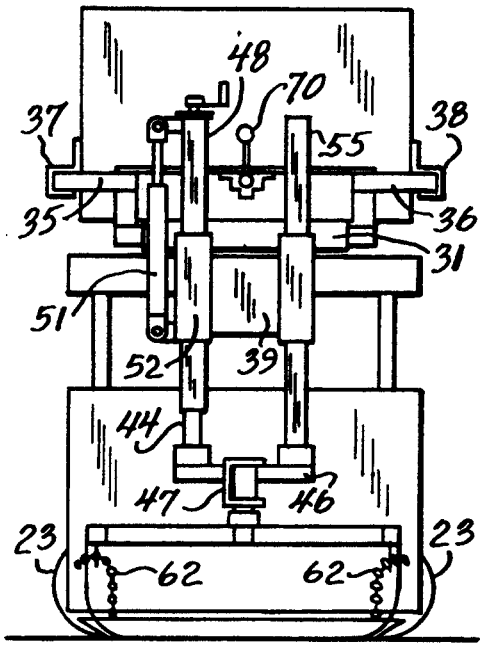
FIG. 5, is an end view taken along the lines 5—5 of FIG. 3.
Figure 6:
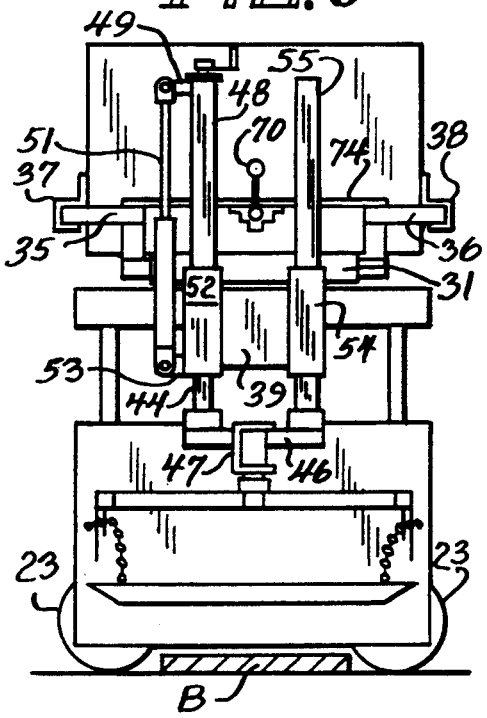
FIG. 6, is a sectional view taken substantially along the lines 6—6 in FIG. 4.
Figure 7:
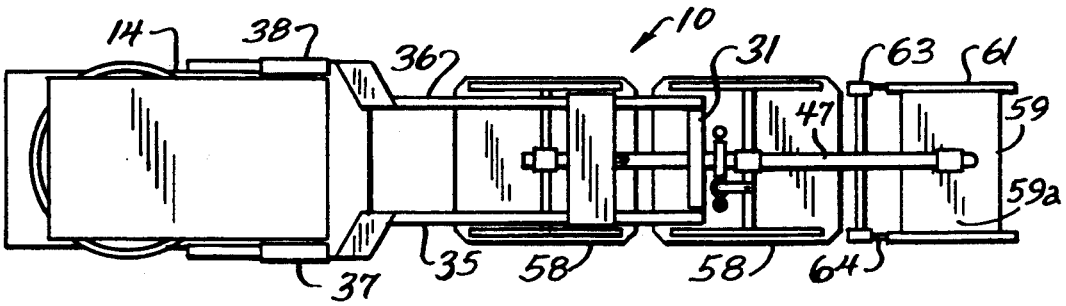
FIG. 7, is a top plan view showing the attachment of the raiseable pan drag apparatus to the carriage finishing unit of the concrete leveling machine in accordance with the present invention.
Figure 9:
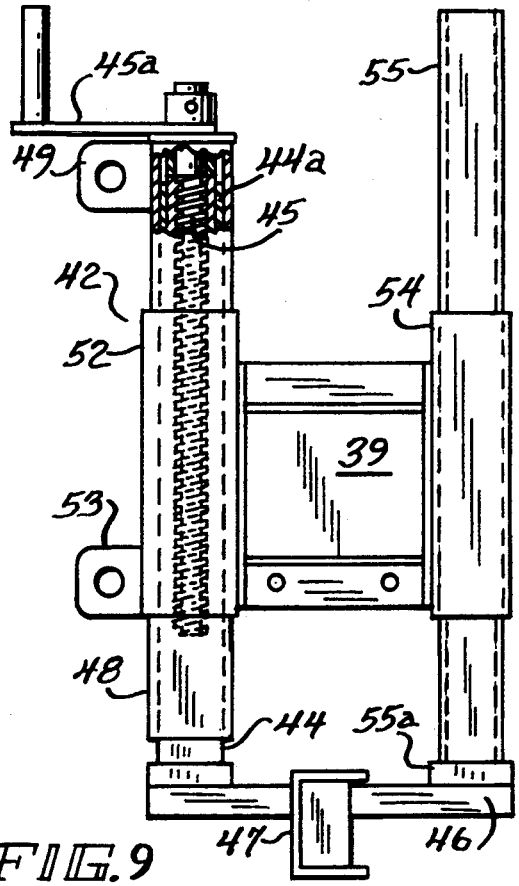
FIG. 9, is an enlarged fragmentary view illustrating the mechanical screw jack assembly for finely adjusting the pan drag apparatus with respect to the surface of the poured concrete in accordance with the present invention.
Figure 10:
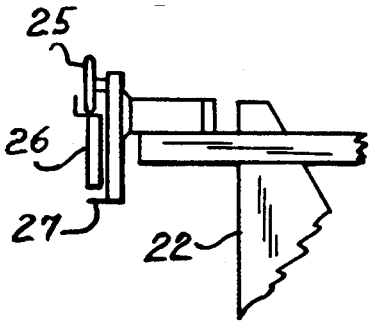
FIG. 10, is an enlarged fragmentary view illustrating the attachment of the carriage unit to the frame of the concrete leveling machine in accordance with the present invention.

The pan drag means or apparatus 10 is mounted on a upright plate member 31*a*, which is fixedly attached to the tubular mounting member 31, by hingedly mounting a drag pan lift frame member 39 to the tubular mounting member plate 31*a*. A pan drag vertical adjustment mechanism 42 is provided and includes an elongated inner cylindrical jack member 44 having a feed screw 45 threadedly mounted therein, with the upper portion of the free screw 45 being secured to the inner jack member 44 by a nut member 44*a* (FIG. 9), with the lower end of the inner jack member 44 being secured by suitable connection (not shown) to a pan lift bottom frame member 46 (FIGS. 2, 5 and 6). The pan lift bottom frame member 46 is secured by suitable brackets or means 50 to an elongated frame mounting member 47 that extends substantially perpendicularly rearwardly from the carriage 22 of the concrete finishing machine 12 in a plane substantially parallel to the mounting legs 35 and 36.

The inner jack member 44 is positioned within a elongated tubular outer jacket member or weldment 48 that includes a bracket member 49 positioned at the upper end thereof which acts as one anchor point to secure one end of a piston and cylinder apparatus or unit 51. The remaining portion of the outer jack tubular member 48 is slidably mounted within a sleeve member 52 that is integral to the drag pan lift frame member 39. The sleeve 52 includes a bracket member 53 which anchor acts as an anchor point for the other end of the piston and cylinder apparatus or unit 51 to secure the unit 51 to the drag pan lift frame member 39. The drag pan lift frame member 39 includes a second sleeve member 54 thereon which is adapted to receive a tubular guide member 55 which has its lower end thereof 55*a* anchored to the bottom pan lift frame 46. The tubular guide member 55 is a secondary but, preferably, necessary support member that assists on stabilizing that portion of the pan drag apparatus 10 that is attached and suspended from the bottom pan frame member 46 as the pan drag apparatus is raised and/or lowered.

Additionally, a hand crank 45*a* is secured to the upper end portion of the feed screw 45. Rotation of the hand crank 45*a* rotates the feed screw within the inner jack member 44 and to thereby finely adjust the inner jack member and frame mounting member 47 vertically relative to the drag pan lift frame member 39 to provide a fine adjustment means for the pan drag apparatus 10. By this fine adjustment means or mechanism, the resultant pan drag means may be finely adjusted vertically with respect to the graded and leveled concrete surface, as will hereinafter be described.

Suspended below the bottom pan lift frame member 39 is an elongated frame mounting member 47 which supports and pulls the rigid drag pan plate or members 58, as well as a flexible textured pan drag member 59, across the concrete surface to engage the surface of the graded concrete to the seal and texturize the concrete surface, as desired. Attached to the elongated frame member 47, is at least one H-configured frame member 60. At least one rigid drag pan plate member 58 is suspended by chain means 62 from the frame member 60. The chain means 62 suspends the rigid drag pan 58 to permit the drag pan to fully engage the grade concrete surface to seal the same. As shown in FIGS. 1–7, the pan drag means or apparatus 10 includes two rigid drag pans members 58 suspended from frame mounting member 47 mounted to the elongated frame member 47 intermediately and forwardly of the engagement of frame member 60 with the bottom pan lift frame member 46. Located at the rear end of the elongated frame mounting member 47 is a flexible textured drag pan member 59. The textured drag pan member 59 is mounted to a frame member 63 having a sleeve members 64 which are adapted to receive and hold tubular extensions 61 to which the textured flexible drag pan mat 59*a* is attached. Suitable fastening means (not shown) secures the mat 59*a* to the tubular extensions 61 (FIG.2). The flexible textured drag pan mat is suspended to engage the sealed concrete surface to texturize the surface as desired.

As pointed out above, the upper portion of the inner jack member 44 includes a hand crank 45*a* secured thereto. Upon rotation of the hand crank 45*a*, the feed screw 45 rotates causing inner jack member 44 to raise or lower the pan lift bottom frame member 39 to finely adjust the degree of contact between the drag pans plate members 58 and the textured drag mat member 59*a* of the pan drag means and the concrete surface to precisely control the degree of contact therebetween. This fine adjustment means permits the pan drag apparatus 10 to maximize the sealing and texturizing of the concrete surface and supplements the adjustment of the apparatus with respect to the raising and lowering of the apparatus by the hydraulic adjustment mechanism 42, that has been described above. As disclosed herein,- the hydraulic adjustment mechanism will raise and lower the pan drag apparatus approximately within a 12 inch range. However, this distance may be increased or decreased substantially depending upon the length of the stroke of the piston and cylinder unit 51 and the length of the inner jack shaft 44.

Figure 8:
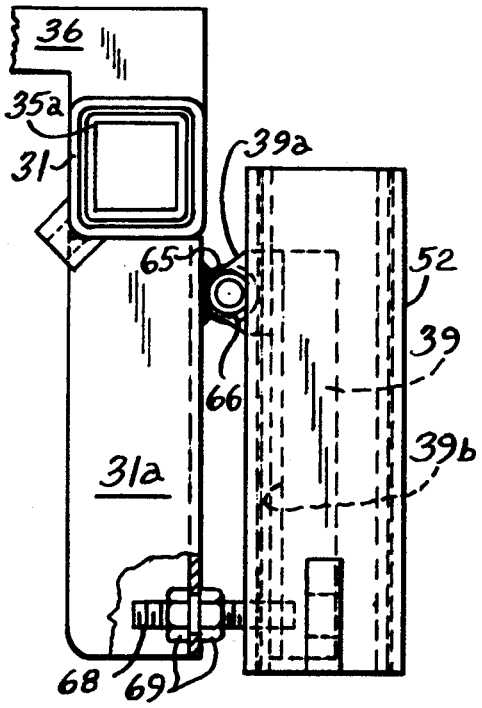
FIG. 8, is an enlarged fragmentary plan view of the hinged attachment of the drag pan lift frame member to the tubular mounting member extending rearwardly from the moveable carriage unit in accordance with the present invention.

As is shown in FIG. 8, pan drag adjustment mechanism 42 is pivotly mounted through the pan drag lift frame member 39 to the tubular mounting member plate 31*a* attached to the tubular mounting member 31. The tubular mounting member 31 is positioned about two weldments 35*a* that extend inwardly from the paralleled legs 35 and 36. The pan drag lift frame member 39 through brackets 39*a* is hingedly mounted to a sleeve member 65 secured to tubular mounting plate member 31*a* by a bolt 66. A pair of bolts 68 extending through the member plate 31*a* engage the inner surface 39*b* of the pan drag lift frame member 39. Tightening members 69 are threaded onto the bolts 68 to permit adjustment of the engagement of the end of adjustment bolts 68 with the inner surface 39*b* of the pan drag lift frame member 39. In this manner, the perpendicular attachment of the adjustment mechanism 42 is achieved to insure that the elongated frame member 47, from which the rigid drag pan plate members 58 and flexible textured drag pan member 59 suspended, is properly positioned parallel to the concrete surface to permit the drag pan members 58 and 59 properly engages the graded concrete surface to seal and texturize the concrete surface.

Figure 11:
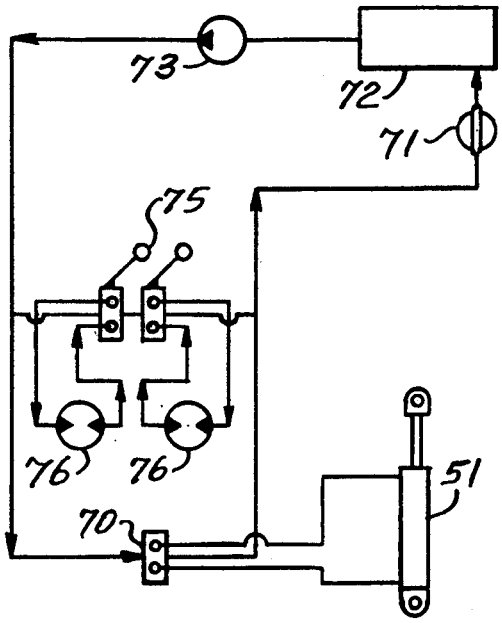
FIG. 11, is a diagram of the hydraulic circuitry of the raiseable pan drag assembly shown in FIGS. 1 and 2 in accordance with the present invention.

As illustrated in FIG. 11, the hydraulic circuitry is described the operation for raising and lowering the pan drag apparatus 10. The piston and cylinder means 51 is connected (not shown) to a directional control valve 70 which is operably connected to a hydraulic oil filter 71 which cooperates with the hydraulic oil reservoir 72 to direct the fluid through a hydraulic pump 73 wherein the fluid may be directed through the control valve 70 to raise and lower the piston and cylinder 51, as desired. Also, the flow of hydraulic fluid may be directed through a directional control valve 75 which controls the flow of the fluid through hydraulic motors 76 which communicate with the paving rollers 23 on the concrete finishing member or unit 14 to control the rotation thereof. As shown in FIG. 2, the directional control valve or switch 70 may be mounted on a plate member 74 secured to the paralleled legs or 35 and 36, respectively. However, it is certainly within the scope of the present invention that the control valve and switch member 70 may be mounted adjacent to the control console 15 to permit the operator of the concrete finishing machine 12 to predetermindly control the raising and lowering of the pan drag apparatus 10.

As shown in FIGS. 3 and 5, the normal operation of the concrete finishing or leveling machine 12 occurs when both the concrete finishing member unit 14 or carriage 22 is in the downward engaging position with the surface of the poured concrete and the pan drag apparatus 10 is in the downward engaging position with respect to the graded concrete surface. When the finishing machine 12 engages a box-out B or raised frame work in the paved roadway, the operator of the machine may hydraulically raise the pan drag apparatus 10 to clear the box-out in the poured roadway, as illustrated in FIGS. 4 and 6.

The above described invention provides a novel concrete finishing machine having a raiseable pan drag apparatus which is independently operable to engage the poured and graded concrete to finish and seal the concrete surface. Additionally, a novel and unique apparatus is disclosed for the attachment of an independently operable raiseable pan drag apparatus to the movable carriage unit of a concrete leveling machine. Finally, a raiseable pan drag apparatus is provided having a plurality of rigided drag pans and at least one flexible textured drag pan member which is engageable with the grade of the poured concrete to seal and texturize the concrete surface. However, it is clearly within the scope of the present invention that the pan drag apparatus may be comprised of a single flexible textured drag pan member or may be comprised of a single rigid drag pan plate member, depending upon the desired sealing and texturizing of the concrete surface.

We claim:

1. A pan drag apparatus for use in conjunction with a concrete finishing machine movable longitudinally along an elongated body of poured concrete and having a finishing unit engageable with the surface of the concrete and movable transversely back and forth across the body of concrete to grade the same, comprising:

supporting means mounted to and extending rearwardly from the finishing unit and moveable transversely back and forth across the body of concrete, pan drag means mounted to said supporting means extending rearwardly from the finishing unit for engaging the graded concrete surface to finish and seal the same as the finishing unit moves transversely back and forth across the body of concrete, means for raising and lowering said pan drag means with respect to the concrete surface, and control means for operatively actuating said means for raising and lowering said pan drag means between an upward raised position to a downward engaging position wherein said pan drag means engages the graded concrete surface to seal and finish the same.

2. The pan drag apparatus in accordance with claim 1 wherein said means for raising and lowering said pan drag means includes a hydraulically actuated piston and cylinder unit.

3. The pan drag apparatus in accordance with claim 1 wherein said supporting means includes a pair of mounting members extending rearwardly from the finishing unit in substantially parallel alignment.

4. The pan drag apparatus in accordance with claim 1 wherein said pan drag means includes at least one rigid drag pan plate member engageable with the graded concrete surface to seal and finish the concrete surface.

5. The pan drag apparatus in accordance with claim 4 wherein said pan drag means further includes at least one flexible texturing drag pan member positioned rearwardly from at least one rigid drag pan plate member which engages the concrete surface to texturize the concrete surface.

6. The pan drag apparatus in accordance with claim 3 wherein said pair of mounting members extending rearwardly from the finishing unit include an outer support member mounted to the ends thereof to which said pan drag means is mounted thereto.

7. The pan drag apparatus in accordance with claim 3 wherein the finishing unit includes a pair of mounting sleeves associated therewith, with each mounting sleeve adapted to receive and anchor one of the mounting members to permit the mounting members to extend rearwardly from the finishing unit in substantially parallel alignment.

8. The pan drag apparatus in accordance with claim 6 wherein said pan drag means includes a lift frame member hingedly mounted to said outer support member, with said lift frame member including a pair of sleeve members associated therewith, with at least one of said sleeve members being adapted to slidably receive an outer jack member therein, with the other of said sleeve members being adapted to receive an elongated guide member slidably moveable therein.

9. The pan drag apparatus in accordance with claim 8 wherein said outer jack member includes an inner jack member therein having a feed screw portion threadedly supported by said outer jack member, with said lower end of said inner jack member and said lower end of said elongated guide member being coupled to a pan lift bottom frame member, with said upper end of said outer jack member and said at least one of said sleeve members each including bracket means for anchoring a hydraulically actuated piston and cylinder unit for raising and lowering said pan lift bottom frame member.

10. The pan drag apparatus in accordance with claim 9 wherein said pan lift bottom member further includes an elongated frame mounting member positioned in a plane substantially parallel to the plane of said supporting means.

11. The pan drag apparatus in accordance with claim 9 wherein said inner jack member includes a crank member rotatably secured to said feed screw member, with said crank member and said feed screw member comprising manual adjustment means for raising and lowering said pan lift bottom frame member.

12. The pan drag apparatus in accordance with claim 2 wherein said control means includes a directional control valve for feeding hydraulic fluid to said hydraulically actuated piston and cylinder unit.

13. A concrete leveling machine movable longitudinally along a pair of spaced-apart guide rails positioned on opposite sides of the roadway upon which concrete is to be poured, including in combination:

a carriage finishing unit suspended from the concrete leveling machine and movable transversely between the opposite sides of the roadway as the concrete leveling machine moves longitudinally along the roadway, with said carriage finishing unit engageable with the poured concrete to level and grade the same, supporting means mounted to and extending rearwardly from said carriage finishing unit and movable transversely between opposite sides of the roadway, pan drag means mounted to said supporting means extending rearwardly from said carriage finishing unit, with said pan drag means movable vertically between an upward raised position wherein said pan drag means is disengaged from the surface of the graded concrete and a downward engaging position wherein said pan drag means is in contact with the surface of the graded concrete to seal and texturize the same, and hydraulically actuated piston and cylinder means associated with said pan drag means for moving said pan drag means between the upward raised position and the downward engaging position.

14. The concrete leveling machine in accordance with claim 13 further including control means operatively connected to said hydraulically actuated piston and cylinder means for moving said pan drag means between the upward raised position and the downward engaging position.

15. The concrete leveling machine in accordance with claim 13 wherein said support means includes a pair of mounting members extending rearwardly from said carriage finishing unit in substantially parallel alignment.

16. The concrete leveling machine in accordance with claim 13 wherein said pan drag means includes at least one rigid drag pan plate member engageable with the graded concrete surface to seal and finish the concrete surface.

17. The concrete leveling machine in accordance with claim 16 wherein said pan drag means further includes at least one flexible texturing drag pan member positioned rearwardly from at least one rigid drag pan plate member which engages the concrete surface to texturize the concrete surface.

18. The concrete leveling machine in accordance with claim 16 wherein said pair of mounting members extending rearwardly from said carriage finishing unit includes an outer support member mounted to the ends thereof to which said pan drag means is mounted thereto.

19. The concrete leveling machine in accordance with claim 16 wherein said carriage finishing unit includes a pair of mounting sleeves associated therewith, with each mounting sleeve adapted to receive and anchor one of the mounting members to permit the mounting members to extend rearwardly from said finishing unit in substantially parallel alignment.

20. The concrete leveling machine in accordance with claim 18 wherein said pan drag means includes a lift frame member hingedly mounted to said outer support member, with said lift frame member including a pair of sleeve members associated therewith, with at least one of said sleeve members being adapted to slidably receive an outer jack member therein, with the other of said sleeve members being adapted to receive an elongated guide member slidably moveable therein.

21. The concrete leveling in accordance with claim 20 wherein said outer jack member includes an inner jack member therein having a feed screw portion threadedly supported by said outer jack member, with said lower end of said inner jack member and said lower end of said elongated guide member being coupled to a pan lift bottom frame member, with said upper end of said outer jack member and said at least one of said sleeve members each including bracket means for anchoring said hydraulically actuated piston and cylinder means for raising and lowering said pan lift bottom frame member.

22. The concrete leveling machine in accordance with claim 21 wherein said pan lift bottom member further includes an elongated frame mounting member associated therewith and positioned in a plane substantially parallel to the plane of said supporting means.

23. The concrete leveling machine in accordance with claim 21 wherein said inner jack member includes a crank member rotatably secured to said feed screw member, with said crank member and said feed screw member comprising manual adjustment means for raising and lowering said pan lift bottom frame member.

24. The pan drag apparatus in accordance with claim 14 wherein said control means includes a directional control valve for feeding hydraulic fluid to said hydraulically actuated piston and cylinder unit.

* * * * *

UNITED STATES PATENT AND TRADEMARK OFFICE

CERTIFICATE OF CORRECTION

PATENT NO. : 5,388,927
DATED : February 14, 1995
INVENTOR(S) : Ewald R. Ulmer and Larry G. Eben It is certified that error appears in the above-indentified patent and that said Letters Patent is hereby corrected as shown below:

Column 1, line 67, delete "Further objection" insert --A further object--;

Signed and Sealed this

Eighteenth Day of April, 1995

Bruce Lehman

*Attest:*

BRUCE LEHMAN

*Commissioner of Patents and Trademarks*

*Attesting Officer*